United States Patent [19]

Greenberg et al.

[11] 4,098,075

[45] Jul. 4, 1978

[54] RADIAL INFLOW COMBUSTOR

[75] Inventors: Paul B. Greenberg, Manchester; Robert P. Lohmann, South Windsor; Philip M. Wing, East Hartford, all of Conn.

[73] Assignee: United Technologies Corporation, Hartford, Conn.

[21] Appl. No.: 691,814

[22] Filed: Jun. 1, 1976

[51] Int. Cl.[2] ..... F02C 7/22

[52] U.S. Cl. ..... 60/39.36; 60/39.71; 431/173; 431/177; 431/183

[58] Field of Search ..... 60/39.71, 39.74 R, 39.65, 60/DIG. 11, 39.36; 431/173, 177, 182–184

[56] References Cited

U.S. PATENT DOCUMENTS

| | | | |
|---|---|---|---|
| 2,177,225 | 10/1939 | Ohlsson | 431/173 |
| 2,395,103 | 2/1946 | Clausen et al. | 431/173 |
| 3,613,360 | 10/1971 | Howes | 60/39.74 R |
| 3,934,409 | 1/1976 | Quillevere et al. | 60/39.71 |
| 3,968,644 | 7/1976 | Fehler | 60/39.74 R |
| 3,973,395 | 8/1976 | Markowski et al. | 60/39.71 |
| 3,981,675 | 9/1976 | Szetela | 60/39.65 |

FOREIGN PATENT DOCUMENTS

| | | | |
|---|---|---|---|
| 466,474 | 4/1974 | Switzerland | 60/39.69 |

*Primary Examiner*—Robert E. Garrett
*Attorney, Agent, or Firm*—Norman Friedland

[57] ABSTRACT

An annular pilot combustor for a turbine type power plant includes radial inflow air and fuel nozzles judiciously oriented to improve heat load characteristics, eliminate a diffuser passage and shorten the overall combustor and supporting parts.

5 Claims, 3 Drawing Figures

FIG. 2
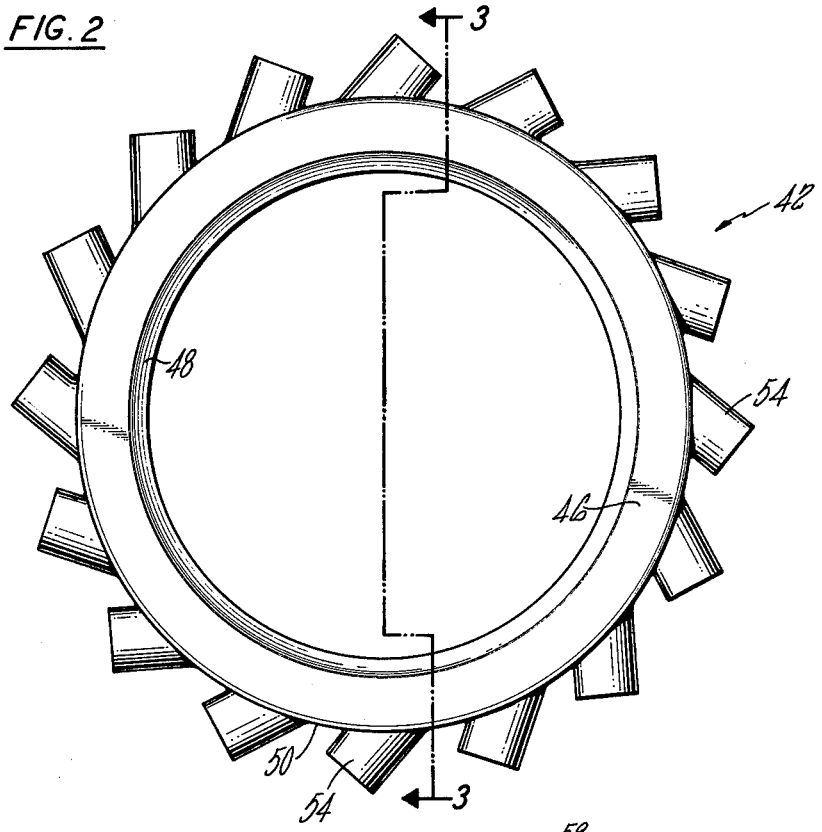
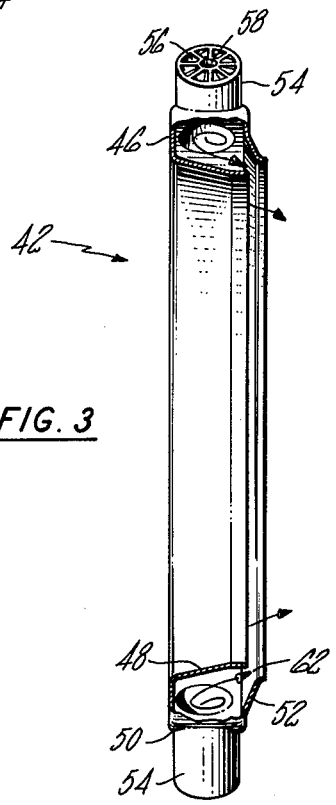
FIG. 3

RADIAL INFLOW COMBUSTOR

BACKGROUND OF THE INVENTION

This invention relates to combustors for gas turbine power plants and more particularly to the pilot combustor and construction thereof.

Typically, the pilot combustor is designed to face the front end of the combustion chamber and to include a plurality of nozzles mounted on the front end so as to inject fuel axially into the combustion zone. Pilot combustors are used in a relatively large engine and are operative during the low thrust power levels. The secondary nozzles are utilized for higher thrust levels but may also be actuated during the lower power regimes. In an annular swirl combustor the fuel manifold is, in certain installations, in proximity to the outer shroud and its diffuser. To feed the fuel nozzles for the pilot combustor the fuel lines are typically routed through the support strut of the diffuser to the combustor front end. In this type of installation, at least three diffusers are needed to permit the proper distribution of combustion, cooling and dilution air while allowing for the required routing of the fuel lines.

We found that this invention permits the routing of fuel lines, achieving the required air distribution while eliminating the need for one of the diffusers and its attendant passageways. This particular routing of the fuel line eliminates the necessity of passing through the strut, reducing the envelope for accommodating the pilot combustor, shortening the overall combustor length and thereby, realizing a reduction of engine weight and size and reducing shaft critical speed problems.

According to this invention the pilot combustor is designed to have radial inflow air and fuel nozzles mounted about an annular pilot combustor. The fuel lines are routed through the outer wall instead of the bulkhead on the front of the combustor. Also, the invention contemplates the judicious orientation of the fuel nozzle with respect to the annular pilot combustion chamber so that the hot gases leaving the swirl cups, which house the fuel nozzles and air swirl vanes, impinges on the opposite inner wall of the annular chamber at an angle that is substantially tangential thereto. This avoids localized heat loads requiring less cooling air with an attendant increase in combustor efficiency.

SUMMARY OF THE INVENTION

An object of this invention is to provide for a turbine type power plant an improved pilot combustor.

A still further object of this invention is to provide in a combustion chamber a radial inflow fuel nozzle mounted in an annular pilot combustor.

A still further object of this invention is to provide for an annular swirl combustor that includes a plurality of circumferentially mounted swirl cups including a control fuel nozzle in an annular combustion chamber oriented so that the hot gases discharging from the cups impinge on a substantial tangent of the inner wall of the chamber.

A still further object of this invention is to provide for a swirl combustor an annular pilot combustor with radial inflow fuel nozzles having improvements to an existing design by shortening the overall combustor length and eliminating a diffuser passage.

Other features and advantages will be apparent from the specification and claims and from the accompanying drawings which illustrate an embodiment of the invention.

BRIEF DESCRIPTION OF THE DRAWINGS

FIG. 2 is a view in elevation of the pilot combustor.

FIG. 3 is a sectional view taken along line 3—3 of FIG. 2. cl DESCRIPTION OF THE PREFERRED EMBODIMENT Referring to FIG. 1, as best shown, flow from the axial flow compressor discharges from the last row of blades 10 (one partially shown) into annular passage 12 via vanes 14. The flow discharging from the vanes has a swirl component of velocity. Passage 12 is formed from the outer wall 16 and the inner wall 18, it being appreciated that these distances are with respect to the engine center line. The compressor discharge air is routed to the annular burner 20 via the passage 22 which is formed from the extension of wall 16 and the splitter 24. This part of the annular burner is well known and does not form part of this invention so that for the sake of convenience and simplicity a detailed description thereof is omitted. Suffice it to say that a portion of compressor discharge air supports combustion in burner 20 and an additional portion is fed into the inner shroud 26 via diffuser 25 for cooling purposes. Air discharging from the combustor drives the turbine mounted immediately downstream thereof. For further details of swirl burning, reference is made to U.S. Pat. Nos. 3,701,255; 3,872,664 and 3,675,419 incorporated herein by reference. Reference should also be made to U.S. patent application Ser. No. 691,813 filed on even date by Paul B. Greenberg, Robert P. Lohmann and Philip M. Wing and entitled Combustor Diffuser for Turbine Type Power Plant and Construction Thereof also assigned to the same assignee.

Figure 1:
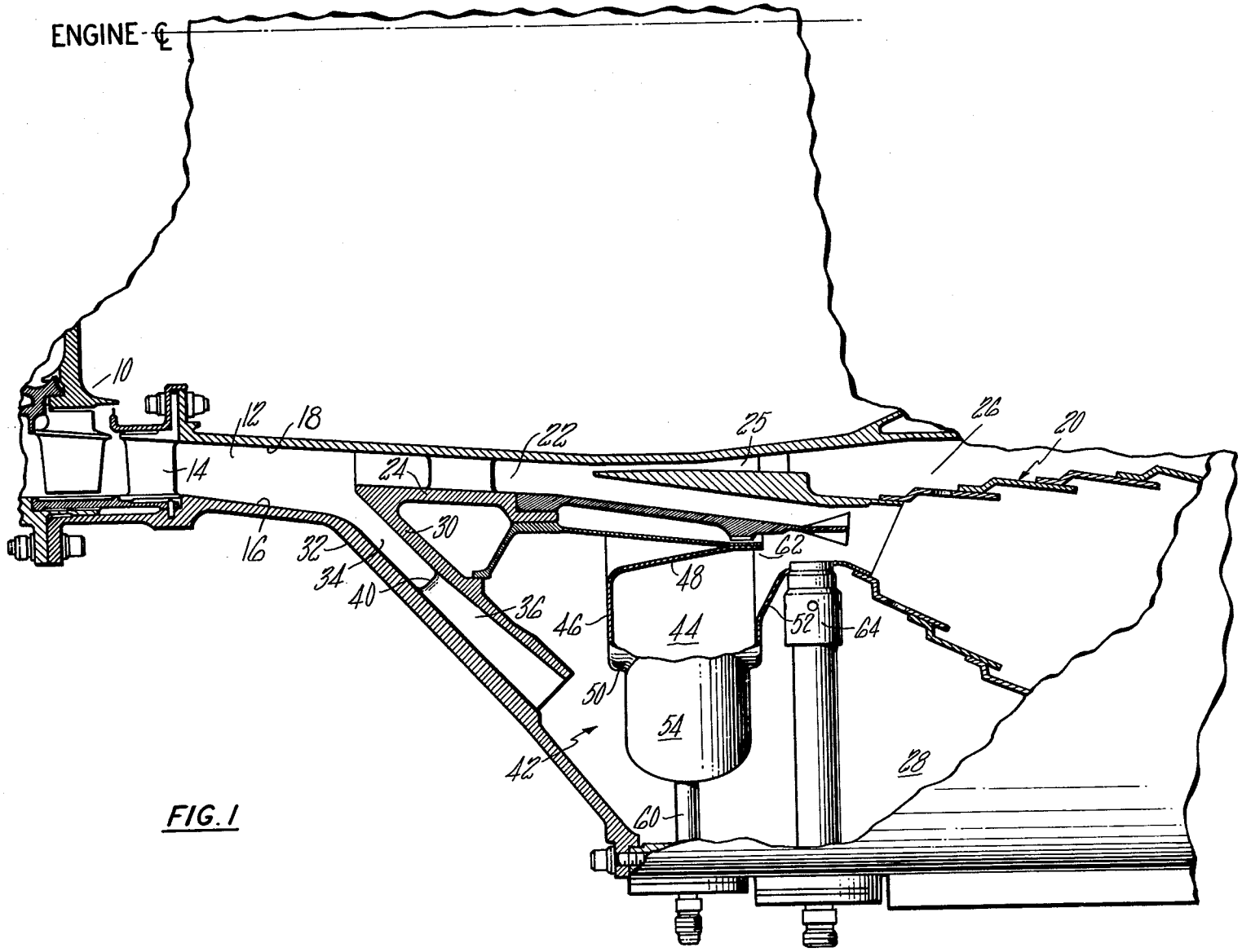
FIG. 1 is a partial view partly in elevation, partly in section and schematically illustrating this invention.

A still additional portion of the air in passage 12 is bled to the outer shroud 28 where it surrounds the outer burner liner and is used for cooling purposes. The splitter wall 30 and diffuser outer wall 32 define a passage 34 for leading the bled air to the diffuser passage 36. The angle of the passage 34 with respect to passage 12 is selected to effectively bleed the compressor discharge air. Because the centrifugal force on the swirling air tends to force it to flow radially outward the inclination of the passage relative to passage 12 may be higher.

Struts 40 are spaced circumferentially in annular diffuser passage 36 and support this assembly and may be integral with either wall 30 or 32.

In accordance with this invention and best seen in FIGS. 1–3 the radial inflow pilot combustor 42 is disposed between the swirl combustor 20 and diffuser passage 36, where pilot combustor 42 comprises an annular combustion chamber 44 mounted about the engine center line and defined by annular closed wall or front bulkhead 46, inner wall 48, outer wall 50 and rear bulkhead 52. A plurality of inlets 54 are judiciously mounted about the circumference of outer wall 50 and each include a swirl cup 56 having a plurality of swirl vanes 58. A central opening in each swirl cup 56 serves to accommodate a fuel nozzle which is connected by a fuel line 60 (one being shown) extending through the engine casing.

As is apparent from the foregoing air and fuel mixed in swirl cups 56 is fed into the annular volume of combustion chamber 44 and ignited by suitable means (not shown) for continuous combustion where it discharges into swirl combustor 20 through the exit annulus 62, ahead of the secondary nozzles generally illustrated by 64 (one being shown).

Each swirl cup is mounted at a given angle, say 30° to 40°, with respect to the radial line as viewed from the front, so that the hot gases entering the swirl cup impinge on inner wall 48 substantially at a tangent, thereby avoiding localized heat loads. This reduces the heating effect on inner wall 48, reducing the amount of cooling air required and resulting in a more efficient combustor.

Additionally, this construction affords these other advantages;

Placing the swirl cups on the outer wall rather than the front bulkhead permits shortening of the overall combustor length tending to reduce engine weight and shaft critical speed problems.

To help stablize combustion, the air entering the swirl cups is given a rotation about the cup centerline by the swirl vanes. Causing the air to be rotated in the direction shown in FIG. 3 helps the flow to enter the exit annulus 62 without additional turning, reducing pressure loss in the pilot.

Locating the pilot feed on the outer wall instead of the front bulkhead simplifies the mechanical arrangement of the combustor front end.

Locating the pilot feed on the outer wall simplifies aerodynamic design by reducing the number of diffuser passages in the front end of the combustor.

It should be understood that the invention is not limited to the particular embodiments shown and described herein, but that various changes and modifications may be made without departing from the spirit or scope of this novel concept as defined by the following claims.

We claim:

1. A pilot combustor for a main combustor having an annular chamber including a rear, inner, top and front wall, the rear wall having an annular exit opening communicating with the main combustor, a plurality of air/fuel inlets mounted circumferentially about the outer wall defining a radial inlet with respect to the center line and being disposed on an angle relative to the radial center line of said chamber so that the gases generated by said fuel/air mixture discharging from said inlets impinge said inner wall substantially tangentially, and said inlets being a swirl cup having a plurality of vanes surrounding an aperture leading axially inwardly and communicating with said annular chamber.

2. A pilot combustor as in claim 1 wherein the said swirl cups are mounted at a 30°–40° angle with respect to a radial line viewed from said front wall.

3. A pilot combuster as in claim 1 wherein said swirl cups are cylindrical in shape.

4. For a turbine type power plant, in combination, an annular swirl combustor having an outer shroud and combustor liner defining a combustion zone, a compressor, passage means leading compressor discharge air to said combustor liner for combustion, diffuser means leading a portion of said compressor discharge air between a space defined by said outer shroud and combustor liner for cooling said combustor, a pilot combustor disposed in said space adjacent to said annular swirl combustor and said diffuser, said pilot combustor including annular wall means defining an annular chamber, a plurality of circumferentially mounted inlet means for fuel and air disposed radially with respect to the combustor chamber for supporting combustion in said chamber, said annular wall means includes an inner wall spaced from said swirl cups and said swirl cups are disposed at an angle relative to a radial line viewed from the front of said power plant whereby the gases discharging therefrom impinge said inner wall means substantially tangentially, and an exit annulus defined by said annular wall means directly communicating with said combustion zone defined by said combustor inner.

5. For a turbine power plant as in claim 4 wherein said inlet means includes a plurality of swirl cups, each of said swirl cups having a central aperture for accommodating fuel and swirl vanes extending radially from said aperture for receiving air discharging from said diffuser, whereby said air and fuel are mixed for combustion therein.

* * * * *